US007041633B2

(12) United States Patent
Tcheou

(10) Patent No.: US 7,041,633 B2
(45) Date of Patent: May 9, 2006

(54) PROCESS FOR PREPARING TABLETS

(75) Inventor: Eric Tcheou, Rue des Commercants (BE)

(73) Assignee: The Procter & Gamble Company, Cincinnati, OH (US)

( * ) Notice: Subject to any disclaimer, the term of this patent is extended or adjusted under 35 U.S.C. 154(b) by 483 days.

(21) Appl. No.: 09/973,518

(22) Filed: Oct. 9, 2001

(65) Prior Publication Data

US 2004/0167054 A1 Aug. 26, 2004

(30) Foreign Application Priority Data

Oct. 12, 2000 (GB) ..... 0024957

(51) Int. Cl.
*C11D 11/00* (2006.01)

(52) U.S. Cl. ..... 510/446; 510/294; 510/298; 510/505

(58) Field of Classification Search ..... 510/446, 510/294, 298, 505
See application file for complete search history.

(56) References Cited

U.S. PATENT DOCUMENTS

| | | | | |
|---|---|---|---|---|
| 5,358,655 | A * | 10/1994 | Kruse et al. | 510/224 |
| 5,747,443 | A * | 5/1998 | Wahl et al. | 510/515 |
| 6,177,393 | B1 * | 1/2001 | McGregor et al. | 510/224 |
| 6,177,398 | B1 * | 1/2001 | McGregor et al. | 510/446 |
| 6,559,115 | B1 * | 5/2003 | Tcheou et al. | 510/446 |
| 6,686,329 | B1 * | 2/2004 | Salager | 510/446 |

FOREIGN PATENT DOCUMENTS

| | | | |
|---|---|---|---|
| DE | 4124701 | A1 * | 1/1993 |
| EP | 0 971 028 | A1 | 1/2000 |
| EP | 0 971 029 | A1 | 1/2000 |
| EP | 0 971 030 | A1 | 1/2000 |
| WO | WO 98/13452 | A1 * | 4/1998 |
| WO | WO 01/10993 | A1 | 2/2001 |

* cited by examiner

*Primary Examiner*—Lorna M. Douyon
(74) *Attorney, Agent, or Firm*—Mark A. Charles; Armina E. Matthews; Marianne Dressmann

(57) ABSTRACT

A process far preparing a detergent tablet, comprising the step of contacting a liquid binder to a base powder, wherein the liquid binder comprises a nonionic surfactant and a dissolution aid.

6 Claims, No Drawings

PROCESS FOR PREPARING TABLETS

CROSS REFERENCE TO RELATED APPLICATIONS

This application claims priority under 35 U.S.C. § 119(A) to Great Britain Application Serial No. 0024957.3, filed Oct. 12, 2000.

1. Technical Field of the Invention

The present invention relates to a process for preparing a detergent composition in the form of a tablet. The present invention also relates to detergent compositions in the form of tablets.

2. Background to the Invention

Detergents, especially laundry detergents, must remove a wide variety of soils and stains from many different surfaces. As a consequence of this, detergents, especially laundry detergents, typically comprise many different ingredients. For powder detergents, consumers do not like to use, and cannot easily handle, large amounts of powder during a single washing cycle. In addition, consumers cannot easily store large amounts of powder detergents. Instead, consumers prefer to use powder detergents in amounts up to 100 g, more preferably up to 50 g, during a single washing process. To meet this consumer demand, detergent manufacturers attempt to formulate powder detergents, especially laundry detergents, so that amounts of up to 100 g, or even up to 50 g, can be used by consumers in a single washing process. In addition to meeting this consumer demand, an added benefit to the detergent manufacturers in formulating powder detergents wherein smaller amounts can be used in a single washing process, is reduced transport costs, handling costs and storage costs, since less detergent powder needs to be handled, stored and transported.

The detergent industry has attempted to solve this problem by developing compact powder detergents which have a higher bulk density than regular powder detergents. Also, the detergent industry has developed detergents in the form of tablets. These tablet detergents are typically made by compressing or compacting a free flowing detergent powder. Detergent compositions in the form of tablets have advantages over free-flowing powder detergents, for example, they are easier to dose, can be stored more easily, and can be handled more easily by the consumer during the washing process.

Although, these compact free-flowing powder detergents and tablet detergents do address the consumer need for detergents which can be used in smaller amounts during the washing process, these detergents still do not always adequately remove a wide variety of soils and stains from many different surfaces.

Traditionally, detergent tablets were prepared by binding a compact detergent powder using a binder and then tableting said powder to form a detergent tablet. The most commonly used binder material is polyethylene glycol (PEG). PEG adequately binds the compact detergent powder, but does not add to the cleaning performance of the tablet.

The inventors have found a process for preparing a detergent tablet which efficiently cleans a wide variety of soils and stains from laundry articles, and also shows good dissolution during the washing process.

The inventors have found that, during the process for preparing a detergent composition in the form of a tablet, a nonionic surfactant and dispensing aid can be used as a liquid binder, to obtain a detergent tablet which adequately cleans a wide variety of soils and stains from many different textile surfaces, and which also adequately dispenses and dissolves during the washing process, especially during a washing process wherein an automatic washing machine is used.

Non ionic surfactants are used in granular laundry detergents, and typically gels upon contact with water, and result in poor dissolution of the detergent during the washing process. Surprisingly, the inventors have found that a nonionic surfactant can be used, in combination with a dispensing aid, as a liquid binder to obtain a detergent tablet adequately dispenses and dissolves during the washing process, and adequately cleans a wide variety of soils and stains from many different textile surfaces.

SUMMARY OF THE INVENTION

In a first embodiment of the present invention, there is provided a process for preparing a detergent composition in the form of a tablet, comprising the step of contacting a liquid binder to a base powder, wherein said liquid binder comprises nonionic surfactant and a dissolution aid.

In a second embodiment of the present invention, there is provided a detergent composition in the form of a tablet, obtainable by a process comprising the step of contacting a liquid binder to a base powder, wherein said liquid binder comprises nonionic surfactant and a dissolution aid.

In a third embodiment of the present invention, there is provided a use of a liquid binder comprising a nonionic surfactant and a dissolution, in a process for preparing a detergent composition in the form of a tablet.

DETAILED DESCRIPTION OF THE INVENTION

The Process

The process of the present invention, herein referred to as "process", prepares a detergent composition in the form of a tablet, comprising the step of contacting a liquid binder to a base powder, wherein said liquid binder comprises nonionic surfactant and dissolution aid. Said composition, said liquid binder, said nonionic surfactant, said dissolution aid are described in more detail hereinafter.

In a preferred embodiment of the present invention, the nonionic surfactant and dissolution aid are typically premixed to form the liquid binder or part thereof. For example, said nonionic surfactant and said dissolution aid are typically pre-mixed to form the liquid binder prior to said liquid binder being contacted to, said base powder.

The liquid binder may be formed in any suitable apparatus, preferably the apparatus is a mixer, for example a static mixer. The base powder may be formed using any suitable apparatus, mixers, high shear mixers and/or granulators, roller compactors, extruders, spheronisers, marumerisers, and combinations thereof. For example a Lodige CB™ mixer, Lodige KM™ mixer.

The liquid binder is contacted to the base powder to form a composition. The liquid binder is typically contacted to the base powder at a temperature of from 40° C. to 90° C., preferably from 50° C. to 70° C., more preferably from 55° C. to 65° C. Said liquid binder is contacted to a base powder, typically by spraying said liquid binder onto said base powder, typically this process step is carried out using a spray-on arm. Preferred spray-on arms comprise at least one nozzle, preferably more than one nozzle for example from 10 to 18 nozzles, connected to a low pressure hot air line, by low pressure it is meant a pressure below 700 $kNm^{-2}$, more preferably below 600 $kNm^{-2}$, more preferably from 150 $kNm^{-2}$to 250 $kNm^{-2}$. The hot air in the hot air line typically at a temperature of from 40° C. to 120° C., preferably at least 60° C.

This composition is then tableted, typically by compression or compaction to form a detergent table. This compression/compaction step is usually carried out in a conventional tablet press, for example, using a standard single stroke press or a rotary press such as Courtoy, Korch, Manesty or Bonals.

Preferably, this compression/compaction step typically uses a force of less than 100000 N, preferably less than 50000 N, or even less than 5000 N, or even less than 3000 N. Most preferably the process of the present invention comprises a step of compressing or compacting the composition, using a force of less than 2500 N. Detergent tablets, suitable for use in auto dish washing applications, may be compressed or compacted using a force higher than 2500 N if required. Other compaction process steps may be used including, for example, briquetting and/or extrusion.

In a preferred embodiment of the present invention, the detergent tablet is typically coated with a coating material.

The coating material is typically contacted to the rest of the detergent tablet at a temperature of from 40° C. to 200° C., more preferably at least 100° C., more preferably at least 150° C., more preferably from 150° C. to 170° C.

Preferred coating materials comprise a combination of (i) a dicarboxylic acid, and (ii) an ion exchange resin or a clay. A preferred ion exchange resin is PG.2000Ca supplied by Purolite. Preferred dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid, derivatives thereof, or combinations thereof, most preferred is adipic acid.

Preferably the weight ratio of components (i) to (ii) above is in the range of from 10:1 to 40:1, more preferably from 20:1 to 30:1.

The coating material, if present, typically comprises from 1% to 10% by weight of the detergent tablet, more preferably from 4% to 8% by weight of the detergent tablet.

Liquid Binder

The liquid binder, herein referred to as "binder" comprises nonionic surfactant and dissolution aid. Said nonionic surfactant and said dissolution aid are described in more detail hereinafter. Preferably, said binder comprises from 1% to 99% nonionic surfactant, and preferably said binder comprises from 1% to 99% dissolution aid.

By liquid it is meant a material which is a liquid at the processing conditions described hereinabove, such as a temperature of from 40° C. to 120° C., preferably from 40° C. to 80° C., or from 50° C. to 70° C.

The liquid binder may comprises some undissolved matter, but the majority of the liquid binder is liquid at the processing conditions described hereinabove, for example at least 80 wt %, or at least 85 wt %, or at least 90 wt %, or at least 95 wt % of the liquid binder is liquid at the processing conditions described hereinabove. Preferably all of the liquid binder is liquid at the processing conditions described hereinabove.

Preferably, the liquid binder comprises less than 20% polyethylene glycol, preferably less than 10%, or less than 5%, or less than 1% polyethylene glycol, most preferably said binder is free of polyethylene glycol.

Preferably, the liquid binder comprises less than 20% water, preferably less than 10%, or less than 5%, or less than 1% water, most preferably said binder is free of water. By water, it is typically meant free-water.

Preferably, the liquid binder comprises less than 20% solvent, preferably less than 10%, or less than 5%, or less than 1% solvent, most preferably said binder is free of solvent. Typically the solvent comprises or consists of methanol, ethanol, propanol, iso-propanol, derivatives thereof, or combinations thereof.

Dissolution Aid

The binder of the process of the invention comprises a dissolution aid.

The dissolution aid may preferably comprise an organic sulfonated compound such as Chd 1–$C_4$ alk(en)yl sulfonic acids and $C_1$–$C_4$ alkyl-aryl sulfonic acids, or derivatives thereof, or salts thereof, or combinations thereof.

Preferably, the dissolution aid may comprise salts of aryl sulfonic acids, including alkali metal salts of benzoic acid, salicylic acid, benzenesulfonic acid, naphtoic acid, derivatives thereof and combinations thereof. Preferred examples of salts of aryl sulfonic acid are sodium, potassium, ammonium benzene sulfonate salts derived from toluene sulfonic acid, xylene sulfonic acid, cumene sulfonic acid, tetralin sulfonic acid, naphtalene sulfonic acid, methyl-naphtalene sulfonic acid, dimethyl-naphtalene sulfonic acid, trimethyl-naphtalene sulfonic acid. Preferred are sodium toluene sulfonate, sodium cumene sulfonate, sodium xylene sulfonate, derivatives thereof, and combinations thereof.

The dissolution aid may comprise salts of dialkyl benzene sulfonic acid such as salts of di-isoporopyl benzene sulfonic acid, ethyl methyl benzene sulfonic acid, alkyl benzene sulfonic acid with a $C_3$–$C_{10}$, preferably $C_4$–$C_9$, linear or branched alkyl chain.

The dissolution aid may comprise a $C_1$–$C_4$ alcohol such as methanol, ethanol, propanol such as iso-propanol, and derivatives thereof, and combinations thereof, preferably ethanol and/or iso-propanol.

The dissolution aid may comprise a $C_4$–$C_{10}$ diol such as hexanediol and/or cyclohexanediol, preferably 1,6-hexanediol and/or 1,4-cyclohexanedimethanol.

The dissolution aid may comprise a compound comprising a chemical group of the following general formula

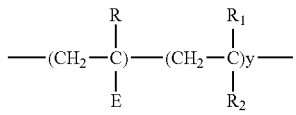

where E is a hydrophilic functional group, R is H or a C1–C10 alkyl group or a hydrophilic functional group, R1 is H or a $C_1$–$C_{10}$ alkyl group or an aromatic group, $R_2$ is H or a cyclic alkyl or an aromatic group. Said compound preferably have a weight average molecular weight of from 1000 to 1000000.

The dissolution aid may comprise 5-carboxy-4-hexyl-2-cyclohexene-1-yl octanoic acid.

The dissolution aid may comprise a cationic compound. Preferably the dissolution aid comprises a cationic polymer, more preferably an ethoxylated cationic diamine. Preferred ethoxylated cationic diamines have the general formula;

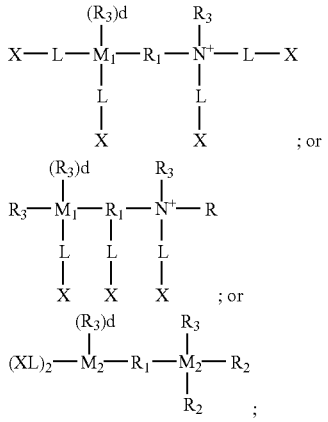

wherein;

$M_1$ is an $N^+$ or N group, preferably an $N^+$ group;

each $M_2$ is an $N^+$ or N group, preferably an $N^+$ group, and at least one $M_2$ is an $N^+$ group;

R is H or $C_1$–$C_4$ alkyl or hydroxyalkyl;

$R_1$ is $C_2$–$C_{12}$ alkylene, hydroxyalkylene, alkenylene, arylene or alkarylene, or a $C_2$–$C_3$ oxyalkylene moiety having from 2 to 20 oxyalkylene units provided that no O—H binds are formed;

each $R_2$ is $C_1$–$C_4$ alkyl or hydroxyalkyl, the moiety L-X or two $R_2$ together form the moiety $(CH_2)_r$—$A^2$—$(CH_2)_s$, wherein $A^2$ is O or $CH_2$, r is 1 or 2, s is 1 or 2, and r+s is 3 or 4;

each $R_3$ is $C_1$–$C_8$ alkyl or hydroxyalkyl, benzyl, the moiety L-X, or two $R_3$ or one $R_3$ and one $R_2$ together form the moiety $(CH_2)_r$—$A^2$—$(CH_2)_s$, wherein $A^2$ is O or $CH_2$, r is 1 or 2, s is 1 or 2, and r+s is 3 or 4;

X is a nonionic group selected from the group consisting of H, $C_1$–$C_4$ alkyl or hydroxyalkyl ester or ether groups and mixtures thereof, preferred esters and ethers are the acetate ester and methyl ether respectively;

L is a hydrophilic chin which contains the polyoxyalkylene moiety $\{(R_6O)m(CH_2CH_2O)n\}$ wherein $R_6$ is $C_3$–$C_4$ alkylene or hydroxyalkylene, m and n are numbers such that the moiety $(CH_2CH_2O)n$ comprises at least 50% by weight of said polyoxyalkylene moiety;

d is 1 when $M_2$ is $N^+$, and is 0 when $M_2$ is N;

n is at least 6.

The positive charge of the N+ groups is offset by the appropriate number of counter anions. Suitable counter anions include $CL^-$, $Br^-$, $SO_3^{2-}$, $SO_4^{2-}$, $PO_4^{2-}$, $MeOS_3^-$ and the like. Particularly preferred are $Cl^-$ and $Br^-$.

A preferred ethoxylated cationic diamine suitable for use herein is known under the tradename as Lutensit K-HD 96 supplied by BASF.

Non ionic Surfactant

The liquid binder comprises nonionic surfactant. Essentially any nonionic surfactant useful for detersive purposes that is liquid at ambient conditions, may be comprised by the binder. Preferred, nonionic surfactants for use herein are described in more detail hereinafter.

Non ionic non-end Capped Ethoxylated Alcohol Surfactant

The alkyl ethoxylate condensation products of aliphatic alcohols with from 1 to 25 moles of ethylene oxide are suitable for use herein. The alkyl chain of the aliphatic alcohol can either be straight or branched, primary or secondary, and generally contains from 6 to 22 carbon atoms, preferably from 12 to 17 carbon atoms, even more preferably from 14 to 15 carbon atoms. Particularly preferred are the condensation products of alcohols having an alkyl group containing from 12 to 17 carbon atoms, preferably from 14 to 15 carbon atoms, with from 3 to 12, more preferably from 5 to 9 moles of ethylene oxide per mole of alcohol.

End-capped Alkyl Alkoxylate Surfactant

A suitable nonionic surfactant for use herein is an end-capped alkyl alkoxylate surfactant, preferred is the epoxy-capped poly(oxyalkylated) alcohols represented by the formula:

$$R_1O[CH_2CH(CH_3)O]_x[CH_2CH_2O]_y[CH_2CH(OH)R_2] \quad (I)$$

wherein $R_1O$ is an epoxy group wherein, $R_1$ is a linear or branched, aliphatic hydrocarbon radical having from 4 to 18 carbon atoms; $R_2$ is a linear or branched aliphatic hydrocarbon radical having from 2 to 26 carbon atoms; x is an integer having an average value of from 0.5 to 1.5, more preferably 1; and y is an integer having a value of at least 15, more preferably at least 20.

Preferably, the nonionic surfactant of formula I, comprises at least 10 carbon atoms in the terminal epoxide unit $[CH_2CH(OH)R_2]$. Suitable nonionic surfactants of formula I, for use herein, are Olin Corporation's POLY-TERGENT® SLF-18B nonionic surfactants, as described, for example, in WO 94/22800, published Oct. 13, 1994 by Olin Corporation.

Ether-capped Poly(oxyalkylated) Alcohols

Preferred nonionic surfactants for use herein, include ether-capped poly(oxyalkylated) alcohols having the formula:

$$R^1O[CH_2CH(R^3)O]_x[CH_2]_kCH(OH)[CH_2]_jOR^2$$

wherein $R^1$ and $R^2$ are linear or branched, saturated or unsaturated, aliphatic or aromatic hydrocarbon radicals having from 1 to 30 carbon atoms; $R^3$ is H, or a linear aliphatic hydrocarbon radical having from 1 to 4 carbon atoms; x is an integer having an average value from 1 to 12, wherein when x is 2 or greater $R^3$ may be the same or different and k and j are integers having an average value of from 1 to 12, and more preferably 1 to 5.

$R^1$ and $R^2$ are preferably linear or branched, saturated or unsaturated, aliphatic or aromatic hydrocarbon radicals having from 6 to 22 carbon atoms with 8 to 18 carbon atoms being most preferred. H or a linear aliphatic hydrocarbon radical having from 1 to 2 carbon atoms is most preferred for $R^3$. Preferably, x is an integer having an average value of from 1 to 9, more preferably from 3 to 7.

As described above, when x is greater than 2, $R^3$ may be the same or different. That is, $R^3$ may vary between any of the alklyeneoxy units as described above. For instance, if x is 3, $R^3$ may be selected to form ethlyeneoxy(EO) or propyleneoxy(PO) and may vary in order of (EO)(PO)(EO), (EO)(EO)(PO); (EO)(EO)(EO); (PO)(EO)(PO); (PO)(PO)(EO) and (PO)(PO)(PO). Of course, the integer three is chosen for example only and the variation may be much larger with a higher integer value for x and include, for example, multiple (EO) units and a much small number of (PO) units.

Particularly preferred nonionic surfactants include those that have a low cloud point of less than 20° C.

Most preferred ether-capped poly(oxyalkylated) alcohol surfactants are those wherein k is 1 and j is 1 so that the surfactants have the formula:

$$R^1O[CH_2CH(R^3)O]_xCH_2CH(OH)CH_2OR^2$$

where $R^1$, $R^2$ and $R^3$ are defined as above and x is an integer with an average value of from 1 to 12, preferably from 1 to 9, and even more preferably from 3 to 7. Most preferred are surfactants wherein $R^1$ and $R^2$ range from 9 to 14, $R^3$ is H forming ethyleneoxy and x ranges from 1 to 9.

The ether-capped poly(oxyalkylated) alcohol surfactants comprise three general components, namely a linear or branched alcohol, an alkylene oxide and an alkyl ether end cap. The alkyl ether end cap and the alcohol serve as a hydrophobic, oil-soluble portion of the molecule while the alkylene oxide group forms the hydrophilic, water-soluble portion of the molecule.

Generally speaking, the ether-capped poly(oxyalkylene) alcohol surfactants suitable for use herein may be produced by reacting an aliphatic alcohol with an epoxide to form an ether which is then reacted with a base to form a second epoxide. The second epoxide is then reacted with an alkoxylated alcohol to form the novel compounds of the present invention.

Non ionic Ethoxylated/propoxylated Fatty Alcohol Surfactant

The ethoxylated $C_6$–$C_{18}$ fatty alcohols and $C_6$–$C_{18}$ mixed ethoxylated/propoxylated fatty alcohols are suitable surfactants for use herein, particularly where water soluble. Preferably the ethoxylated fatty alcohols are the $C_{10}$–$C_{18}$ ethoxylated fatty alcohols with a degree of ethoxylation of from 1 to 12, most preferably these are the $C_{12}$–$C_{18}$ ethoxylated fatty alcohols with a degree of ethoxylation from 1 to 9. Preferably the mixed ethoxylated/propoxylated fatty alcohols have an alkyl chain length of from 10 to 18 carbon atoms, a degree of ethoxylation of from 3 to 9 and a degree of propoxylation of from 1 to 10.

Base Powder

The base powder typically comprises a wide variety of different ingredients, preferred ingredients are selected from the group consisting of building agents, enzymes, bleaching agents, suds supressors, surfactants, fabric softening agents, alkalinity sources, colourants, perfumes, lime soap dispersants, organic polymeric compounds including polymeric dye transfer inhibiting agents, crystal growth inhibitors, heavy metal ion sequestrants, metal ion salts, enzyme stabilisers, corrosion inhibitors, softening agents, optical brighteners, and combinations thereof. The base powder comprises at least two different ingredients, preferably selected from the list above.

The base powder is typically a pre-formed detergent granule. The pre-formed detergent granule may be an agglomerated particle. By agglomerated particle it is typically meant a particle which has already been agglomerated, and thus is already in an agglomerate form, prior to contacting the liquid binder, as described hereinabove.

The average particle size of the base powder is typically from 100 micrometers to 2000 micrometers, preferably from 200 micrometers, or from 300 micrometers, or from 400 micrometers, or from 500 micrometers and preferably to 1800 micrometers, or to 1500 micrometers, or to 1200 micrometers, or to 1000 micrometers, or to 800 micrometers, or to 700 micrometers. Most preferably, the average particle size of the base powder is from 400 micrometers to 700 micrometers.

The bulk density of the base powder is typically from 400 g/l to 1200 g/l, preferably from 500 g/l, or from 550 g/l , or from 600 g/l, or from 750 g/l, and preferably to 850 g/l. Most preferably, the bulk density of the base powder is from 750 g/l to 850 g/l.

Detergent Tablet

The detergent tablet, herein referred to as "tablet", is obtained by a process comprising the step of contacting a liquid binder to a base powder, wherein said liquid binder comprises nonionic surfactant and dissolution aid. The detergent tablet is typically formed by tableting a detergent composition which is formed by contacting a liquid binder to a base powder.

The detergent tablet typically has a diameter of between 20 mm and 60 mm, and typically having a weight of from 10 g to 100 g. The ratio of tablet height to tablet width is typically greater than 1:3.

The tablet typically has a density of at least 900 g/l, preferably at least 1000 g/l, and preferably less than 2000 g/l, more preferably less than 1500 g/l, most preferably less than 1200 g/l.

The detergent tablet typically comprises ingredients selected from the group consisting of builder compound, enzymes, bleaching agents, suds supressors, surfactants, fabric softening agents, alkalinity sources, colourants, perfumes, lime soap dispersants, organic polymeric compounds including polymeric dye transfer inhibiting agents, crystal growth inhibitors, heavy metal ion sequestrants, metal ion salts, enzyme stabilisers, corrosion inhibitors, softening agents, optical brighteners, and combinations thereof.

Preferred optional ingredients are described in more detail hereinafter. All percentages given are on a weight basis of the whole detergent tablet unless specified.

Preferred Optional Ingredients

Builder Compound

The detergent tablet herein preferably comprises a builder compound, typically present at a level of from 1% to 80% by weight, preferably from 10% to 70% by weight, most preferably from 20% to 60% by weight of the detergent tablet.

Highly preferred builder compounds for use in the present invention are water-soluble phosphate builders. Specific examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerisation ranges from 6 to 21, and salts of phytic acid.

Examples of partially water soluble builders include the crystalline layered silicates as disclosed for example, in EP-A-0164514, DE-A-3417649 and DE-A-3742043.

Examples of largely water insoluble builders include the sodium aluminosilicates. Suitable aluminosilicates include the aluminosilicate zeolites having the unit cell formula $Na_z[(AlO_2)_z(SiO_2)y]$. $xH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

Surfactant

Suitable surfactants are selected from anionic, cationic, nonionic ampholytic and zwitterionic surfactants and mixtures thereof.

A typical listing of anionic, nonionic, ampholytic and zwitterionic classes, and species of these surfactants, is given in U.S. Pat. No. 3,929,678 issued to Laughlin and Heuring on Dec. 30, 1975. A list of suitable cationic surfactants is given in U.S. Pat. No. 4,259,217 issued to Murphy on Mar. 31,1981. A listing of surfactants typically included in laundry detergent compositions is given for example, in EP-A-0414 549 and PCT Applications Nos. WO 93/08876 and WO 93/08874.

Non ionic Surfactant

Suitable nonionic surfactants are described hereinabove. For the purpose of the present invention, it is essential that the liquid binder comprise nonionic surfactant. In addition to the nonionic surfactant which is comprised by the liquid binder, the composition may optionally comprise other, or more, nonionic surfactant which is not comprised by the binder. For example, the base powder may comprise nonionic surfactant. For example, the composition, typically the base powder, may comprise nonionic surfactant in the form of a pre-agglomerated particle.

Anionic Surfactant

Essentially any anionic surfactants useful for detersive purposes are suitable. These can include salts (including, for example, sodium, potassium, ammonium, and substituted ammonium salts such as mono-, di- and triethanolamine salts) of the anionic sulfate, sulfonate, carboxylate and sarcosinate surfactants. Anionic sulfate surfactants are preferred.

Other anionic surfactants include the isethionates such as the acyl isethionates, N-acyl taurates, fatty acid amides of methyl tauride, alkyl succinates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates. Resin acids and hydrogenated resin acids are also suitable, such as rosin, hydrogenated rosin, and resin acids and hydrogenated resin acids present in or derived from tallow oil.

Anionic Sulfate Surfactant

Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and -N-($C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates.

Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$–C18, most preferably $C_{11}$–$C_{15}$ alkyl sulfate which has been ethoxylated with from 0.5 to 7, preferably from 1 to 5, moles of ethylene oxide per molecule.

A particularly preferred aspect of the invention employs mixtures of the preferred alkyl sulfate and alkyl ethoxysulfate surfactants. Such mixtures have been disclosed in PCT Patent Application No. WO 93/18124.

Anionic Sulfonate Surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Anionic Carboxylate Surfactant

Suitable anionic carboxylate surfactants include the alkyl ethoxy carboxylates, the alkyl polyethoxy polycarboxylate surfactants and the soaps ('alkyl carboxyls'), especially certain secondary soaps as described herein.

Suitable alkyl ethoxy carboxylates include those with the formula $RO(CH_2CH_20)_x\ CH_2C00^{-M+}$ wherein R is a $C_6$ to $C_{18}$ alkyl group, x ranges from O to 10, and the ethoxylate distribution is such that, on a weight basis, the amount of material where x is 0 is less than 20% and M is a cation. Suitable alkyl polyethoxy polycarboxylate surfactants include those having the formula RO—($CHR_1$—$CHR_2$-O)-$R_3$ wherein R is a $C_6$ to $C_{18}$ alkyl group, x is from 1 to 25, $R_1$ and $R_2$ are selected from the group consisting of hydrogen, methyl acid radical, succini acid radical, hydroxysuccinic acid radical, and mixtures thereof, and $R_3$ is selected from the group consisting of hydrogen, substituted or unsubstituted hydrocarbon having between 1 and 8 carbon atoms, and mixtures thereof.

Alkali Metal Sarcosinate Surfactant

Other suitable anionic surfactants are the alkali metal sarcosinates of formula R—CON ($R^1$) $CH_2$ COOM, wherein R is a $C_5$–$C_{17}$ linear or branched alkyl or alkenyl group, $R^1$ is a $C_1$–$C_4$ alkyl group and M is an alkali metal ion. Preferred examples are the myristyl and oleoyl methyl sarcosinates in the form of their sodium salts.

Amphoteric Surfactant

Suitable amphoteric surfactants for use herein include the amine oxide surfactants and the alkyl amphocarboxylic acids.

Zwitterionic Surfactant

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. Betaine and sultaine surfactants are exemplary zwitterionic surfactants for use herein.

Cationic Surfactants

Cationic ester surfactants used in this invention are preferably water dispersible compound having surfactant properties comprising at least one ester (i.e. —COO—) linkage and at least one cationically charged group. Other suitable cationic ester surfactants, including choline ester surfactants, have for example been disclosed in U.S. Pat. Nos. 4228042, 4239660 and 4260529.

Suitable cationic surfactants include the quaternary ammonium surfactants selected from mono $C_6$–$C_{16}$, preferably $C_6$–$C_{10}$ N-alkyl or alkenyl ammonium surfactants wherein the remaining N positions are substituted by methyl, hydroxyethyl or hydroxypropyl groups.

Softening Ingredient

The softening ingredients suitable for use herein, may be selected from any known ingredients that provides a fabric softening benefit, for example smectite clay.

The smectite clays used herein are typically commercially available. Such clays include, for example, montmorillonite, volchonskoite, nontronite, hectorite, saponite, sauconite, and vermiculite. The clays herein are available under various tradenames, for example, Thixogel #1® and Gelwhite GP® from Georgia Kaolin Co., Elizabeth, N.J.; Volclay BC® and Volclay #325, from American Colloid Co., Skokie, Ill.; Black Hills Bentonite BH450®, from International Minerals and Chemicals; and Veegum Pro and Veegum F, from R. T. Vanderbilt. It is to be recognised that such smectite-type minerals obtained under the foregoing tradenames can comprise mixtures of the various discrete mineral entities. Such mixtures of the smectite minerals are suitable for use herein.

Smectite clays are disclosed in the U.S. Pat. Nos. 3,862,058, 3,948,790, 3,954,632 and 4,062,647. European Patents No.s EP-A-299,575 and EP-A-313,146 in the name of the Procter and Gamble Company describe suitable organic polymeric clay flocculating agents.

Enzymes

Where present, said enzymes are selected from the group consisting of cellulases, hemicellulases, peroxidases, proteases, gluco-amylases, amylases, xylanases, lipases, phospholipases, esterases, cutinases, pectinases, keratanases, reductases, oxidases, phenoloxidases, lipoxygenases, lignin-nases, pullulanases, tannases, pentosanases, malanases, β-glucanases, arabinosidases, hyaluronidase, chondroitinase, laccase or mixtures thereof.

Preferred enzymes include protease, amylase, lipase, peroxidases, cutinase and/or cellulase in conjunction with one or more plant cell wall degrading enzymes.

Said enzymes are normally incorporated in the detergent composition at levels from 0.0001% to 2% of active enzyme by weight of the detergent composition. The enzymes can be added as separate single ingredients (prills, granulates, stabilized liquids, etc . . . containing one enzyme ) or as mixtures of two or more enzymes (e.g. cogranulates).

Bleaching Agent

Suitable bleaching agents include chlorine and oxygen-releasing bleaching agents, preferably oxygen-releasing bleaching agent containing a hydrogen peroxide source and an organic peroxyacid bleach precursor compound. The production of the organic peroxyacid occurs by an in situ reaction of the precursor with a source of hydrogen peroxide. Preferred sources of hydrogen peroxide include inorganic perhydrate bleaches. Compositions containing mixtures of a hydrogen peroxide source and organic peroxyacid precursor in combination with a preformed organic peroxyacid are also envisaged.

Inorganic Perhydrate Bleaches

The detergent tablet herein preferably comprises a hydrogen peroxide source, as an oxygen-releasing bleach. Suitable hydrogen peroxide sources include the inorganic perhydrate salts.

The inorganic perhydrate salts are normally incorporated in the form of the sodium salt at a level of from 1% to 40% by weight, more preferably from 2% to 30% by weight and most preferably from 5% to 25% by weight of the composition.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, preferred executions utilize a coated form of the material which provides better storage stability for the perhydrate salt in the granular product.

Sodium perborate can be in the form of the monohydrate of nominal formula $NaBO_2H_2O_2$ or the tetrahydrate $NaBO_2H_2O_2.3H_2O$.

Alkali metal percarbonates, particularly sodium percarbonate are preferred perhydrates for inclusion in compositions in accordance with the invention. Sodium percarbonate is an addition compound having a formula corresponding to $2Na_2CO_3.3H_2O_2$, and is available commercially as a crystalline solid. Sodium percarbonate, being a hydrogen peroxide addition compound tends on dissolution to release the hydrogen peroxide quite rapidly which can increase the tendency for localised high bleach concentrations to arise.

The percarbonate is most preferably incorporated into such compositions in a coated form which provides in-product stability.

Peroxyacid Bleach Precursor

Peroxyacid bleach precursors are compounds which react with hydrogen peroxide in a perhydrolysis reaction to produce a peroxyacid. Generally peroxyacid bleach precursors may be represented as

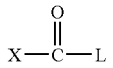

where L is a leaving group and X is essentially any functionality, such that on perhydrolysis the structure of the peroxyacid produced is

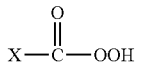

Peroxyacid bleach precursor compounds are preferably incorporated at a level of from 0.5% to 20% by weight, more preferably from 1% to 10% by weight, most preferably from 1.5% to 5% by weight of the composition.

Suitable peroxyacid bleach precursor compounds typically contain one or more N- or O-acyl groups, which precursors can be selected from a wide range of classes. Suitable classes include anhydrides, esters, imides, lactams and acylated derivatives of imidazoles and oximes. Examples of useful materials within these classes are disclosed in GB-A-1586789. Suitable esters are disclosed in GB-A-836988, 864798, 1147871, 2143231 and EP-A-0170386.

Leaving Groups

The leaving group, hereinafter L group, must be sufficiently reactive for the perhydrolysis reaction to occur within the optimum time frame (e.g., a wash cycle). However, if L is too reactive, this activator will be difficult to stabilise for use in a bleaching composition.

Preferred L groups are selected from the group consisting of:

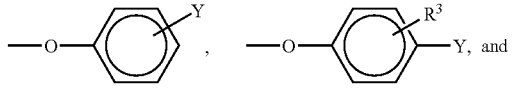

-continued

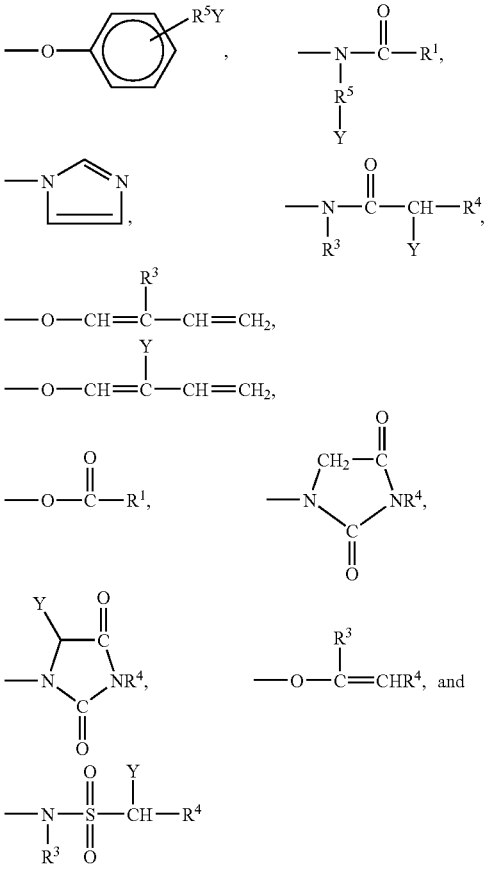

and mixtures thereof, wherein $R^1$ is an alkyl, aryl, or alkaryl group containing from 1 to 14 carbon atoms, $R^3$ is an alkyl chain containing from 1 to 8 carbon atoms, $R^4$ is H or $R^3$, $R^5$ is an alkenyl chain containing from 1 to 8 carbon atoms and Y is H or a solubilizing group. Any of $R^1$, $R^3$ and $R^4$ may be substituted by essentially any functional group including, for example alkyl, hydroxy, alkoxy, halogen, amine, nitrosyl, amide and ammonium or alkyl ammonium groups.

The preferred solubilizing groups are $—SO_3^-M^+$, $—CO_2^-M^+$, $—SO_4^-M^+$, $—N^+(R^3)_4X^-$ and $O←N(R^3)3$ and most preferably $—SO_3^-M^+$ and $—CO_2^-M^+$wherein $R^3$ is an alkyl chain containing from 1 to 4 carbon atoms, M is a cation which provides solubility to the bleach activator and X is an anion which provides solubility to the bleach activator. Preferably, M is an alkali metal, ammonium or substituted ammonium cation, with sodium and potassium being most preferred, and X is a halide, hydroxide, methylsulfate or acetate anion.

Cationic Peroxyacid Precursors

Cationic peroxyacid precursor compounds produce cationic peroxyacids on perhydrolysis.

Typically, cationic peroxyacid precursors are formed by substituting the peroxyacid part of a suitable peroxyacid precursor compound with a positively charged functional group, such as an ammonium or alkyl ammonium group, preferably an ethyl or methyl ammonium group. Cationic peroxyacid precursors are typically present in the compositions as a salt with a suitable anion, such as for example a halide ion or a methylsulfate ion.

The peroxyacid precursor compound to be so cationically substituted may be a perbenzoic acid, or substituted derivative thereof, precursor compound as described hereinbefore. Alternatively, the peroxyacid precursor compound may be an alkyl percarboxylic acid precursor compound or an amide substituted alkyl peroxyacid precursor as described hereinafter Cationic peroxyacid precursors are described in U.S. Pat. Nos. 4,904,406; 4,751,015; 4,988,451; 4,397,757; 5,269,962; 5,127,852; 5,093,022; 5,106,528; U.K. 1,382,594; EP 475,512, 458,396 and 284,292; and in JP 87–318,332.

Suitable cationic peroxyacid precursors include any of the ammonium or alkyl ammonium substituted alkyl or benzoyl oxybenzene sulfonates, N-acylated caprolactams, and monobenzoyltetraacetyl glucose benzoyl peroxides.

Preferred cationic peroxyacid precursors of the N-acylated caprolactam class include the trialkyl ammonium methylene benzoyl caprolactams, particularly trimethyl ammonium methylene benzoyl caprolactam.

Another preferred cationic peroxyacid precursor is 2-(N,N,N-trimethyl ammonium) ethyl sodium 4-sulphophenyl carbonate chloride.

Alkyl Percarboxylic Acid Bleach Precursors

Alkyl percarboxylic acid bleach precursors form percarboxylic acids on perhydrolysis. Preferred precursors of this type provide peracetic acid on perhydrolysis.

Preferred alkyl percarboxylic precursor compounds of the imide type include the $N,N,N^1N^1$ tetra acetylated alkylene diamines wherein the alkylene group contains from 1 to 6 carbon atoms, particularly those compounds in which the alkylene group contains 1, 2 and 6 carbon atoms. Tetraacetyl ethylene diamine (TAED) is particularly preferred.

Other preferred alkyl percarboxylic acid precursors include sodium 3,5,5-tri-methyl hexanoyloxybenzene sulfonate (iso-NOBS), sodium nonanoyloxybenzene sulfonate (NOBS), sodium acetoxybenzene sulfonate (ABS) and penta acetyl glucose. Another preferred alkyl percarboxylic acid precursor is a phenol sulphonate ester of alkyl-amido caproic acid.

Preformed Organic Peroxyacid

The organic peroxyacid bleaching system may contain, in addition to, or as an alternative to, an organic peroxyacid bleach precursor compound, a preformed organic peroxyacid, typically at a level of from 0.5% to 25% by weight, more preferably from 1% to 10% by weight of the detergent tablet.

In a preferred embodiment of the present invention the peracid has the general formula

X-R-C(O)OOH wherein R is a linear or branched alkyl chain having at least 1 carbon atom and X is hydrogen or a substituent group selected from the group consisting of alkyl, especially alkyl chains of from 1 to 24 carbon atoms, aryl, halogen, ester, ether, amine, amide, substituted phthalic amino, imide, hydroxide, sulphide, sulphate, sulphonate, carboxylic, heterocyclic, nitrate, aldehyde, phosphonate, phosphonic or mixtures thereof.

Preferred peracids are selected from the group consisting of phthaloyl amido peroxy hexanoic acid, phthaloyl amido peroxy heptanoic acid, phthaloyl amido peroxy octanoic acid, phthaloyl amido peroxy nonanoic acid, phthaloyl amido peroxy decanoic acid and mixtures thereof.

The peracid is preferably used at a level of from 0.1% to 30%, more preferably from 0.5% to 18% and most preferably 1% to 12% by weight of the detergent tablet.

Metal-containing Bleach Catalyst

The detergent tablet herein which contain bleach as detergent component may additionally contain as a preferred component, a metal containing bleach catalyst. Preferably the metal containing bleach catalyst is a transition metal containing bleach catalyst, more preferably a manganese or cobalt-containing bleach catalyst.

Preferably the detergent tablet herein comprises from 1 ppb (0.0000001%), more preferably from 100 ppb (0.00001%), yet more preferably from 500 ppb (0.00005%), still more preferably from 1 ppm (0.0001%) to 99.9%, more preferably to 50%, yet more preferably to 5%, still more preferably to 500 ppm (0.05%) by weight of the composition, of a metal bleach catalyst as described herein below.

A suitable type of bleach catalyst is a catalyst comprising a heavy metal cation of defined bleach catalytic activity, such as copper, iron cations, an auxiliary metal cation having little or no bleach catalytic activity, such as zinc or aluminum cations, and a sequestrant having defined stability constants for the catalytic and auxiliary metal cations, particularly ethylenediaminetetraacetic acid, ethylenediaminetetra(methylenephosphonic acid) and water-soluble salts thereof. Such catalysts are disclosed in U.S. Pat. No. 4,430,243.

Heavy Metal ion Sequestrant

The detergent tablet herein may contain as an optional component a heavy metal ion sequestrant. By heavy metal ion sequestrant it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the compositions.

Water-soluble Sulfate Salt

The detergent tablet herein optionally contains a water-soluble sulfate salt. Where present the water-soluble sulfate salt is at the level of from 0.1% to 40%, more preferably from 1% to 30%, most preferably from 5% to 25% by weight of the tablet.

The water-soluble sulfate salt may be essentially any salt of sulfate with any counter cation. Preferred salts are selected from the sulfates of the alkali and alkaline earth metals, particularly sodium sulfate.

Alkali Metal Silicate

An alkali metal silicate is a preferred component of detergent tablet herein. A preferred alkali metal silicate is sodium silicate having an $SiO_2$:$Na_2O$ ratio of from 1.8 to 3.0, preferably from 1.8 to 2.4, most preferably 2.0. Sodium silicate is preferably present at a level of less than 20%, preferably from 1% to 15%, most preferably from 3% to 12% by weight of $SiO_2$. The alkali metal silicate may be in the form of either the anhydrous salt or a hydrated salt.

Suds Suppressing System

The detergent tablet herein, when formulated for use in machine washing compositions, preferably comprise a suds suppressing system present at a level of from 0.01% to 15%, preferably from 0.05% to 10%, most preferably from 0.1% to 5% by weight of the composition.

Suitable suds suppressing systems for use herein may comprise essentially any known antifoam compound, including, for example silicone antifoam compounds, 2-alkyl and alcanol antifoam compounds. Preferred suds suppressing systems and antifoam compounds are disclosed in PCT Application No. WO93/08876 and EP-A-705 324.

Other Optional Ingredients

Other optional ingredients suitable for inclusion in the compositions of the invention include perfumes, optical brighteners, dye transfer inhibiting agents, and filler salts, with sodium sulfate being a preferred filler salt.

EXAMPLES

All percentages are on a weight basis unless otherwise specified

TABLE 1

| Liquid binder ingredients[1] | A | B |
|---|---|---|
| Ethoxylated alcohol[2] | 1.1 | 1.7 |
| Lutensit K-HD 96 cationic polymer[3] | 0.7 | 0 |
| 1,4-cyclohexanedimethanol | 0.2 | 0.3 |

[1]Values given in table 1 are percentages by weight of the total detergent tablet.
[2]The ethoxylated alcohol is a $C_{12}$–$C_{18}$ predominantly linear primary alcohol condensed with an average of from 3 to 7 moles of ethylene oxide.
[3]The Lutensit K-HD 96 cationic polymer is supplied by BASF.

TABLE 2

| Base powder ingredients[4] | C | D |
|---|---|---|
| Anionic/Cationic agglomerates[5] | 35 | 35 |
| Anionic Agglomerates[6] | 1.5 | 0 |
| Nonionic agglomerates[7] | 12 | 4.50 |
| Clay extrudate[8] | 0 | 10 |
| Layered Silicate[9] | 1 | 2 |
| Sodium Percarbonate | 10 | 15 |
| Bleach activator agglomerates 1[10] | 4 | 0 |
| Bleach activator agglomerates 2[11] | 0 | 3 |
| Sodium Carbonate | 12 | 12 |
| EDDS/Sulphate particle[12] | 0.6 | 0.2 |
| Tetrasodium salt of Hydroxyethane Diphosphonic acid | 0.5 | 0.3 |
| Soil Release Polymer | 6 | 2.5 |
| Fluorescer | 0.1 | 0.1 |
| Zinc Phthalocyanide sulphonate encapsulate[13] | 0.05 | 0.01 |
| Suds supressor[14] | 2 | 1.5 |
| Soap20 | 0 | 0.8 |
| Citric acid21 | 3 | 4 |
| Sodium Citrate | 3 | 2 |
| Sodium Acetate | 4 | 3 |
| Protease | 0.5 | 0.3 |
| Amylase | 0.2 | 0.05 |
| Cellulase | 0 | 0.1 |
| Perfume | 0.6 | 1 |
| Miscellaneous | to 100% | to 100% |

[4]Values given in table 2 are percentages by weight of the total detergent tablet.
[5]Anionic/Cationic agglomerates comprise from 20% to 45% anionic surfactant, from 0.5% to 5% cationic surfactant, from 0% to 5% TAE80, from 15% to 30% SKS6, from 10% to 25% Zeolite, from 5% to 15% Carbonate, from 0% to 5% Carbonate, from 0% to 5% Sulphate, from 0% to 5% Silicate and from 0% to 5% Water.
[6]Anionic agglomerates comprise from 40% to 80% anionic surfactant and from 20% to 60% DIBS.
[7]Nonionic agglomerates comprise from 20% to 40% nonionic surfactant, from 0% to 10% polymer, from 30% to 50% Sodium Acetate anhydrous, from 15% to 25% Carbonate and from 5% to 10% zeolite.
[8]Clay agglomerates comprise from 90% to 100% of CSM Quest 5A clay, from 0% to 5% alcohol or diol, and from 0% to 5% water.
[9]Layered silicate comprises from 90% to 100% SKS6 and from 0% to 10% silicate.
[10]Bleach activator agglomerates 1 comprise from 65% to 75% bleach activator, from 10% to 15% anionic surfactant and from 5% to 15% sodium citrate.
[11]Bleach activator agglomerates 2 comprises from 75% to 85% TAED, from 15% to 20% acrylic/maleic copolymer (acid form) and from 0% to 5% water.
[12]Ethylene diamine N,N-disuccinic acid sodium salt/Sulphate particle comprises from 50% to 60% ethylene diamine N,N-disuccinic acid sodium salt, from 20% to 25% sulphate and from 15% to 25% water.
[13]Zinc phthalocyanine sulphonate encapsulates are from 5% to 15% active.
[14]Suds suppressor comprises from 10% to 15% silicone oil (ex Dow Corning), from 50% to 70% zeolite and from 20% to 35% water.

Example 1 i) Liquid binder A was prepared by mixing the ingredients of liquid binder A shown in table 1, in a mixer.
ii) Base powder C was prepared by mixing the ingredients of base powder C shown in table 2, in a concrete mixing drum.
iii) Liquid binder A was sprayed onto Base powder C, to form a composition.
iv) The composition is then tableted using a GEPA press with a maximum load of 500 kg. 40 g of composition is introduced in a 41×41 mm square die, and the composition is pressed to obtain a hardness of 6.5 kp as indicated in a Vankel VK200, to form a detergent tablet.

Example 2

A detergent tablet is prepared according to the process described in example 1, except that liquid binder A, the ingredients thereof are shown in table 1, and base powder D, the ingredients thereof are shown in table 2, are used to form the tablet.

Example 3

A detergent tablet is prepared according to the process described in example 1, except that liquid binder B, the ingredients thereof are shown in table 1, and base powder C, the ingredients thereof are shown in table 2, are used to form the tablet.

Example 4

A detergent tablet is prepared according to the process described in example 1, except that liquid binder B, the ingredients thereof are shown in table 1, and base powder D, the ingredients thereof are shown in table 2, are used to form the tablet.

Example 5

Detergent tablets weighing 40 g each, are prepared according to examples 1, 2, 3 and 4. The detergent tablets are coated with a coating material comprising adipic acid and PG.-2000Ca. 2.5 g of coating material is applied to each detergent tablet.

The coating material is prepared by mixing 95 g adipic acid with 5 g ion exchange resin such as PG.-2000Ca supplied by Purolite, at a temperature of 160° C.

What is claimed is:

1. A process for preparing a detergent tablet, comprising the step of contacting a liquid binder to a base powder, wherein said liquid binder comprises a nonionic surfactant and a dissolution aid, said dissolution aid is selected from the group consisting of 1,4-cyclohexanediol, 1,6-hexanediol and 2,2,4 trimethyl 1,3 pentanediol.

2. A process according to claim 1, whereby said base powder comprises an agglomerated particle.

3. A process according to claim 1, whereby the mean particle size of said base powder is from 100 micrometers to 2000 micrometers.

4. A process according to claim 1, whereby said base powder has a bulk density of from 400 g/l to 900 g/l.

5. A process according to claim 1, whereby said liquid binder is free from polyethylene glycol.

6. A process according to claim 1, whereby said nonionic surfactant comprises a $C_{12}$–$C_{18}$ predominantly linear primary alcohol condensed with an average of from 5 to 9 moles of ethylene oxide.

* * * * *